US009104178B2

(12) United States Patent
Gyger et al.

(10) Patent No.: US 9,104,178 B2
(45) Date of Patent: Aug. 11, 2015

(54) METHOD FOR MAKING A SPRING FOR A TIMEPIECE

(75) Inventors: Thomas Gyger, Le Fuet (CH); Vincent Von Niederhäusern, Courrendlin (CH)

(73) Assignee: ROLEX S.A., Geneva (CH)

( * ) Notice: Subject to any disclaimer, the term of this patent is extended or adjusted under 35 U.S.C. 154(b) by 499 days.

(21) Appl. No.: 13/514,137

(22) PCT Filed: Dec. 9, 2010

(86) PCT No.: PCT/CH2010/000309

§ 371 (c)(1),
(2), (4) Date: Jul. 24, 2012

(87) PCT Pub. No.: WO2011/069273

PCT Pub. Date: Jun. 16, 2011

(65) Prior Publication Data

US 2012/0281510 A1 Nov. 8, 2012

(30) Foreign Application Priority Data

Dec. 9, 2009 (EP) ..... 09405221

(51) Int. Cl.

| | |
|---|---|
| ***G04B 1/10*** | (2006.01) |
| ***G04B 1/14*** | (2006.01) |
| ***C22C 1/00*** | (2006.01) |
| ***C22C 45/04*** | (2006.01) |
| ***G04B 17/06*** | (2006.01) |

(52) U.S. Cl.

CPC ..... *G04B 1/145* (2013.01); *C22C 1/002* (2013.01); *C22C 45/04* (2013.01); *G04B 17/066* (2013.01); *Y10T 29/49579* (2015.01)

(58) Field of Classification Search

CPC ..... G04B 1/145; G04B 17/066; C22C 1/002; C22C 45/04

USPC ..... 368/140, 203; 148/403, 561

See application file for complete search history.

(56) References Cited

U.S. PATENT DOCUMENTS

| | | | | |
|---|---|---|---|---|
| 3,187,416 | A | 6/1965 | Tuetey et al. | |
| 3,624,883 | A | 12/1971 | Baehni | |
| 4,580,336 | A * | 4/1986 | Kerley et al. | 29/605 |

(Continued)

FOREIGN PATENT DOCUMENTS

| | | |
|---|---|---|
| CN | 1237250 A | 12/1999 |
| EP | 0942337 A1 | 9/1999 |

(Continued)

OTHER PUBLICATIONS

Pol'Dyaeva G. P. et al, "Elastic Characteristics and Microplastic Deformation of Iron-Base Amorphous Alloys", Metal Science and Heat Treatment USA, vol. 25, No. 9-10, Sep. 1983, pp. 653-654, XP002633344, ISSN: 0026-0673.

(Continued)

*Primary Examiner* — Vit W Miska

(74) *Attorney, Agent, or Firm* — Westerman, Hattori, Daniels & Adrian, LLP

(57) ABSTRACT

The invention relates to a method for making a spring for a timepiece that comprises at least one monobloc ribbon of metal glass including at least one curvature. The method is characterized in that said method comprises the step of shaping by means of plastic-deformation said monobloc ribbon in order to obtain at least a portion of said curvature.

26 Claims, 4 Drawing Sheets

(56) References Cited

U.S. PATENT DOCUMENTS

Figure 1:
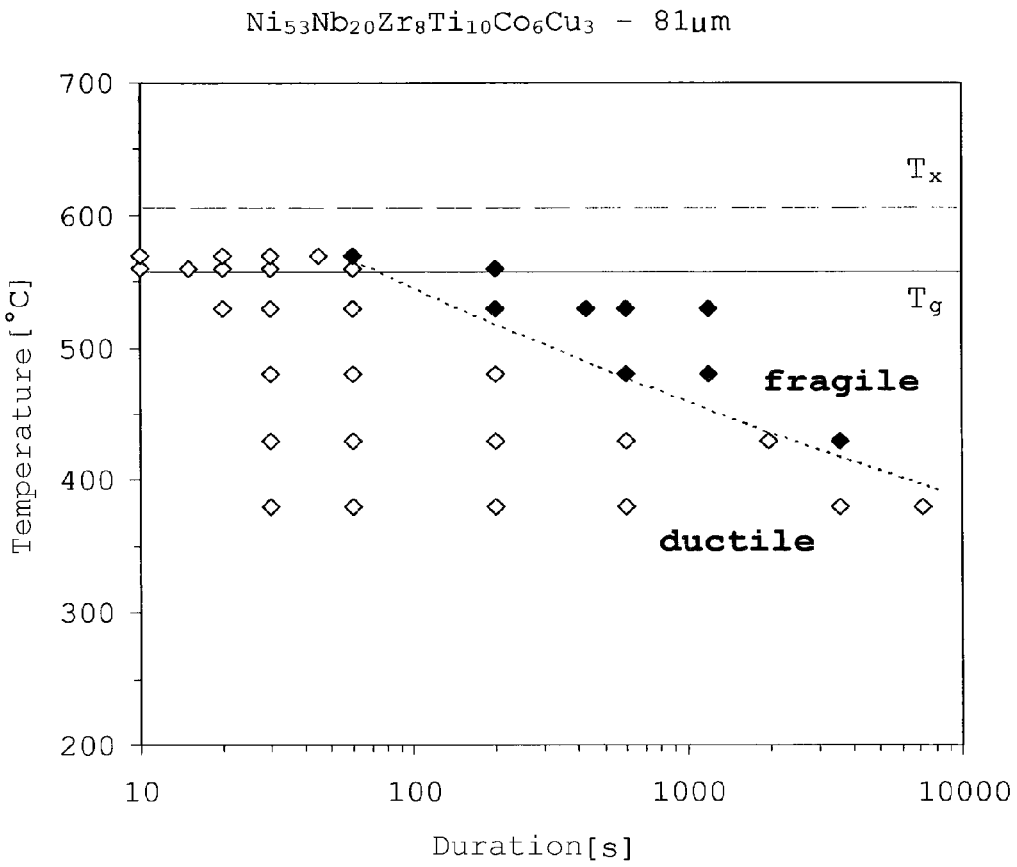

| | | | | |
|---|---|---|---|---|
| 4,865,664 | A | 9/1989 | Sato et al. | |
| 5,288,344 | A * | 2/1994 | Peker et al. | 148/403 |
| 5,368,659 | A * | 11/1994 | Peker et al. | 148/403 |
| 5,735,975 | A * | 4/1998 | Lin et al. | 148/403 |
| 5,772,803 | A | 6/1998 | Peker et al. | |
| 6,843,594 | B1 | 1/2005 | Moteki et al. | |
| 8,348,496 | B2 | 1/2013 | Gritti et al. | |
| 8,720,246 | B2 | 5/2014 | Gritti et al. | |
| 2001/0030908 | A1 * | 10/2001 | Moteki et al. | 368/140 |
| 2007/0133355 | A1 * | 6/2007 | Hara et al. | 368/140 |
| 2009/0194205 | A1 | 8/2009 | Loffler et al. | |
| 2009/0303842 | A1 * | 12/2009 | Gritti et al. | 368/140 |

FOREIGN PATENT DOCUMENTS

| | | | |
|---|---|---|---|
| EP | 2 133 756 | A2 | 12/2009 |
| FR | 1 533 876 | A | 7/1968 |
| JP | 2002-80949 | A | 3/2002 |
| WO | 2007/038882 | A1 | 4/2007 |

OTHER PUBLICATIONS

Berner G. -A., "Dictionnaire Prefessionnel Illustré de l'Horlogerie", 1961, Chambre suisse de l'Horlogerie, La Chaux-de Fonds, XP002580071, pp. 780-781, paragraph [3484C]; Figure 3484C.

Koba E. S. et al., "Effect of plastic deformation and high pressure working on the structure and microhardness of metallic glasses", Acta Metallurgica & Materialien, vol. 42, No. 4, Apr. 1, 1994, pp. 1383-1388.

Lu J. et al, "Deformation behavior of the Zr41.2Ti13.8Cu12.5Ni10Be22.5 bulk metallic glass over a wide range of strain-rates and temperatures", Acta Materialia 51, pp. 3429-3443, 2003.

International Search Report for PCT/CH2010/000309 on mailing date May 24, 2011.

Office Action issued Apr. 14, 2015 for corresponding Chinese Application No. 2010800562653 (15 pages).

Office Action issued Jun. 20, 2013 for corresponding Chinese Application No. 2010800562653 (16 pages).

* cited by examiner

METHOD FOR MAKING A SPRING FOR A TIMEPIECE

The present invention relates to a method of making a timepiece spring which comprises at least one monolithic ribbon of metallic glass having at least one curvature.

Document EP 0 942 337 has already proposed a watch comprising a mainspring made of amorphous metal. In actual fact, only a strip formed of an amorphous metal laminated structure assembled with epoxy resin is described in that document. A proposed alternative form is an assembly of strips assembled by spot-welding the two ends and the point of inflection of the unconstrained shape of the spring.

The major problem with such a strip is the high risk of delamination of the laminated structure as it is being shaped and following the repeated windings-up and unwinding to which such a spring is subjected. Because resin does not age well and loses its properties, this risk becomes all the more accentuated.

This solution does not guarantee the functionality and fatigue behavior of the spring. Furthermore, the modeling of the theoretical shape proposed for the spring does not take the behavior of a laminated material into consideration.

The use of several thin strips assembled with one another is the result of the difficulty in obtaining thick strips of metallic glass because the known methods, developed in the 1970s for amorphous ribbons used for their magnetic properties, can be used for making, using rapid quenching, ribbons only up to around thirty microns.

International application published under the number WO 2007/038882 describes a composite material made up of a substantially continuous amorphous matrix containing graphite particles. This composite material is supposedly able to be used to make, in particular, springs, although no indication is given as to the method of making such springs. In addition, the size of the particles dispersed in the matrix of the composite is of the same order of magnitude as the typical thickness of watch-making springs, and this raises doubts as to the usability of such a composite for such an application.

U.S. Pat. No. 5,772,803 relates to an object comprising a torsion spring that can be obtained by cooling a liquid metal alloy at a rate lower than 500° C./s in order to obtain a bulk amorphous metal alloy, and then shape this alloy. The only shaping mentioned in that document is casting in a mold. It so happens that the casting of an alloy that has superior mechanical performance, notably a high elastic limit, produces ribbons which are fragile under bending at the dimensions necessary for producing a mainspring.

French patent No. FR 1 553 876 relates to a device and a method for making watch-making hairsprings. The nature of the bands used to make these hairsprings is not indicated in this document. Given the age of the document, one might very well assume that this is a polycrystalline metal alloy for self-compensating hairsprings of the Invar® type, such as the Nivarox® alloy (which is an FeNi-based alloy).

American U.S. Pat. No. 3,624,883 relates to a method of making a spring coiled into a spiral and fixed to a collet involving fixing a ribbon to a collet then turning the latter and subjecting the whole to a heat treatment in order to fix the ribbon in its coiled position. The nature of the ribbon is not indicated in that document. Since that patent claims a priority dating from 1968, and given the description, it is probable that the ribbon was a polycrystalline metal alloy for hairsprings of the same type as that described in French patent No. FR 1 553 876 mentioned above. It is known to those skilled in the art that the role and therefore the properties of a hairspring are very different from those of a mainspring.

The application of the aforementioned technique to metallic glasses is therefore not straightforward because of the great differences thereof between a crystalline metal alloy and an amorphous metal alloy known as a "metallic glass".

As indicated in the "background of the invention" part of the aforementioned international application WO 2007/038882, bulk metallic glasses are fragile and their plastic deformation at ambient temperature is therefore highly ill advised.

Likewise, in their article entitled "Deformation behavior of the $Zr_{41.2}Ti_{13.8}Cu_{12.5}Ni_{10}Be_{22.5}$ bulk metallic glass over a wide range of strain-rates and temperatures", Acta Materialia 51, 3429-3443 (2003), authors J. Lu et al. state "in spite of their metallic bonding, all the metallic glasses discovered so far exhibit shear localization at room temperature, leading to catastrophic shear failure immediately following yield" (cf. p. 3430, paragraph 2).

Plastic deformation of an amorphous metal alloy can be achieved only through the creation of slip bands. This deformation mechanism is completely different than that of crystalline metal alloys. Plastic deformation of an amorphous metal alloy is generally undesired, because it results in rapid breakage of the component being stressed.

It is therefore very clear to a person skilled in the art that the elastic limit is a limit that must not be crossed for fear of damaging the material. Therefore, to a person skilled in the art, any plastic deformation of a bulk metallic glass is to be proscribed.

Another fundamental difference between a multiphase polycrystalline alloy such as Nivaflex® (a CoNiCr-based alloy for high-performance springs) and an amorphous metal alloy is that, in order to be able to achieve its maximum mechanical properties, the Nivaflex® alloy has to be toughened by work hardening and by precipitation of phases during a heat treatment. In the case of an amorphous metal alloy, its mechanical characteristics are obtained upon solidification and its mechanical properties cannot be enhanced by subsequent plastic deformation and/or subsequent heat treatment. Thus, it is necessary to apply a heat treatment to Nivaflex® mainsprings in order to obtain the desired mechanical properties, something which is not at all the case for a spring made of metallic glass.

BRIEF DESCRIPTION OF THE INVENTION

The inventors have surprisingly discovered that it was possible to subject a ribbon of metallic glass to plastic deformation and to use it on an industrial scale with its plastic deformation, notably in the form of a spring which is repeatedly mechanically stressed inside the barrel of a timepiece movement.

They then put this discovery to good use in a method for making a timepiece spring as claimed in claim 1.

This method therefore allows functional timepiece springs, particularly mainsprings, to be made of metallic glass, on an industrial scale.

The features and advantages of the method that forms the subject of the invention will become apparent during the course of the following description which is illustrated by various diagrams.

Figure 2A:
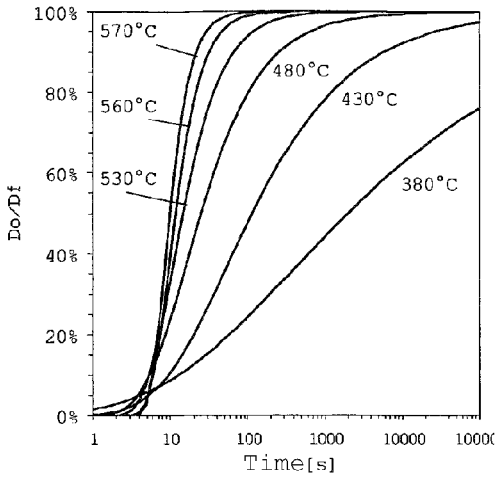
Figure 2B:
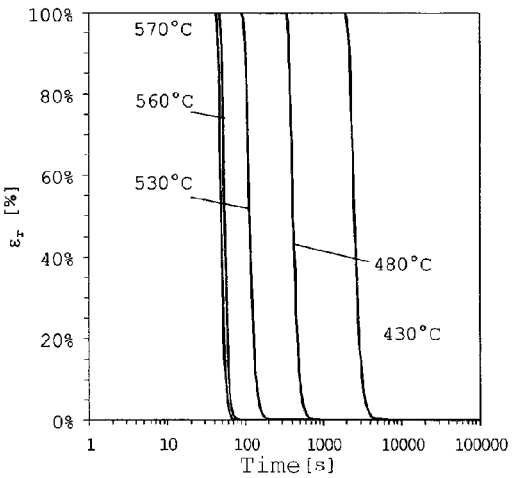
Figure 3A:
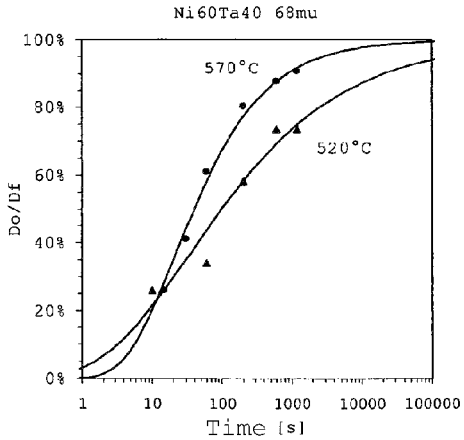
Figure 3B:
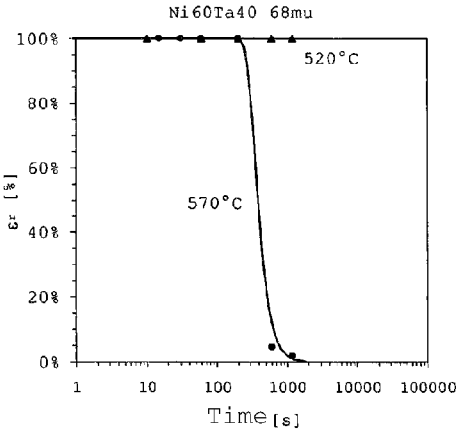
Figure 4A:
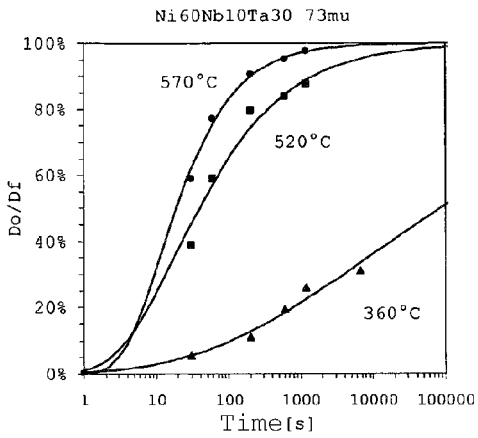
Figure 4B:
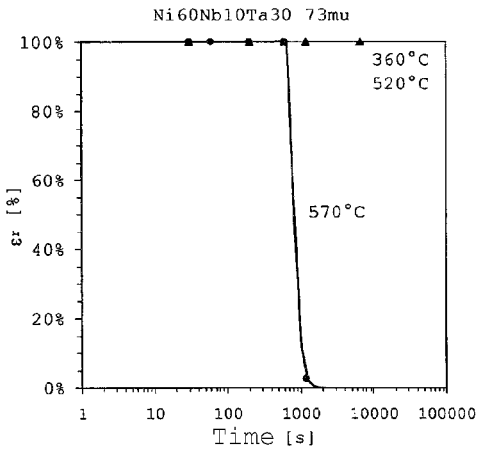
Figure 5A:
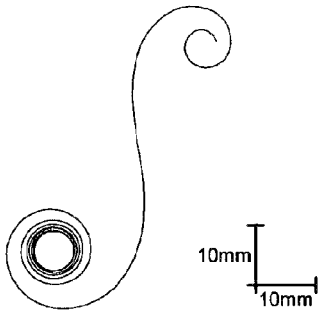
Figure 5B:
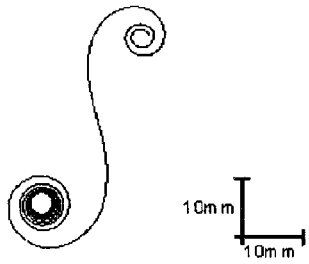
Figure 6A:
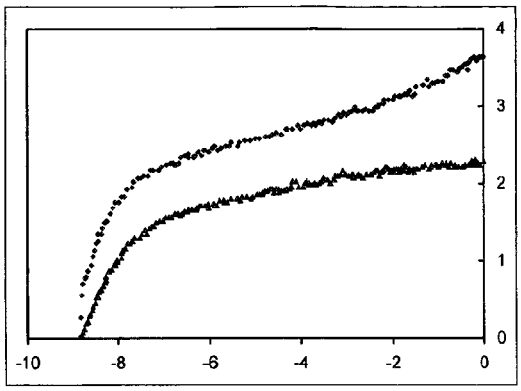
Figure 6B:
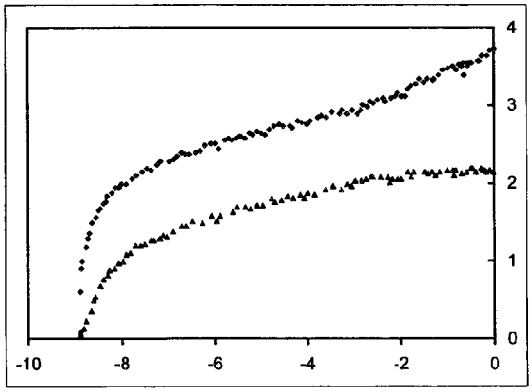

FIG. 1 is a diagram of ductility/fragility as a function of annealing conditions;

FIG. 2*a* is a diagram of fixing at various temperatures;

FIG. 2*b* is a diagram of deformation at break as a function of the duration of annealing at various temperatures;

FIGS. 3*a*, 3*b* are diagrams corresponding to those of FIGS. 2*a* and 2*b* respectively, for another alloy;

FIGS. 4*a*, 4*b* are diagrams corresponding to those of FIGS. 2*a* and 2*b* respectively, for another alloy;

FIG. 5*a* is a plan view of the unconstrained shape of a spring;

FIG. 5*b* is a plan view of the unconstrained shape of this same spring the curvatures of which correspond to 60% of the theoretical unconstrained shape; and FIGS. 6*a*, 6*b* represent the winding-up/unwinding curves for a mainspring part of which has been hot-formed and the internal part of which has been shaped by plastic deformation, and of a mainspring the shaping of which has been done entirely by plastic deformation (cold forming) respectively, with the torque [in mNm] as a function of the number of turns of development.

DETAILED DESCRIPTION OF THE INVENTION

To perform the method according to the invention it is advantageous to use a metal alloy capable on cooling of forming an amorphous or essentially amorphous metal alloy known as a "metallic glass", because of the excellent mechanical properties that arise out of the particular structure of such alloys.

It is particularly advantageous to use metallic glasses the mechanical properties of which are superior to those of the traditional polycrystalline alloys used in the prior art, such as the Nivaflex® alloy for example. As a result, the invention set out hereinbelow relates more specifically to metallic glasses the elastic limit of which is higher than 2400 MPa.

By way of examples of such amorphous metal alloys, mention may be made of alloys based on Ni, Co and/or Fe.

During the course of their research, the inventors also noticed that in order to produce a functional spring, which means to say one that guarantees a certain return torque and good reliability when used in a timepiece, the ribbon has preferably to be made of an amorphous or essentially amorphous alloy with the required thickness to achieve the functional properties and to be initially ductile under bending. Indeed, above and beyond a certain thickness the ribbon may demonstrate a fragile behavior under bending, and this would impair the reliability of the spring.

In order to obtain a clock-making spring of good performance, such as a mainspring, the thickness of the ribbon will advantageously be at least 50 μm, because smaller thicknesses are unable to provide sufficient return torque. Likewise, the thickness will advantageously be at most 150 μm.

According to one advantageous embodiment of the invention, a small thickness and an amorphous nature are obtained simultaneously by hyperquenching, namely by jetting the liquid metal alloy capable of forming the metallic glass onto a cold and moving substrate, such as a rotating roll, possibly a water-cooled rotating roll.

Such jetting may be performed for example using a method such as planar flow casting, melt-spinning and twin roll casting.

For preference, the parameters for the jetting and the cooling are chosen in such a way as to obtain a rate of cooling of the liquid metal alloy in excess of 10000° C./s. This is because such a cooling rate, obtained by hyperquenching, actually encourages ductility through the creation of "voids" within the structure of the metallic glass.

The cooling rates obtained using a casting technique, such as by injecting the liquid metal alloy into a copper mold, are markedly lower and are unable, for the high elastic limit metallic glasses known to us, of simultaneously yielding a thickness and a ductility that are sufficient for correct operation of a high-performance clock-making spring.

In addition, it is desirable for the jetting to be done in such a way as to obtain a monolithic ribbon having a thickness of between 50 and 150 μm, preferably between 50 and 120 μm, and more preferably, of between 50 and 100 μm. The metallic glass obtained under these conditions is then very different from bulk metallic glass (BMG) which is in excess of 1 mm thick.

In the case of a mainspring, the spring cannot be used directly after casting in the form of a straight ribbon, but has to be shaped so as to be able to develop the desired torque, as described in document WO 2010/000081A1. It is therefore necessary to be able to shape the ribbon so that it adopts a given unconstrained shape, prior to the steps of coiling and winding it up in a barrel.

As far as the shaping of the monolithic ribbon of metallic glass is concerned, the plastic deformation is advantageously carried out at ambient temperature and under ambient conditions. This plastic deformation must not impair the mechanical properties of the ribbon, so as to allow it repeated mechanical stressing, for example inside a barrel.

According to one advantageous embodiment of the invention, in addition to the curvature achieved through plastic deformation, an additional curvature is achieved by deforming the ribbon elastically, for example in a support, and by fixing the new shape obtained using a heat treatment at a temperature and for a duration that do not result in any weakening of the spring. This additional curvature may in particular be performed on the parts of the ribbon that are not curved by plastic deformation. The heat treatment can be carried out before or after the plastic deformation, advantageously before the plastic deformation, particularly if the heat treatment affects the plastically deformed zone.

Appropriate treatment (annealing) temperature and duration are chosen inside a temperature and duration window in which the alloy of said metallic glass maintains its ductile behavior under bending. This window thus in practice corresponds to a deformation at break greater than 2%. These conditions make it possible to achieve the following objectives:

i) lengthening the maximum duration of treatment before weakening occurs, ii) fixing the shape, iii) maintaining the mechanical properties obtained after production of the ribbon (hardness and ductility) and iv) the avoidance of crystallization.

EXAMPLE 1

Ribbons of $Ni_{53}Nb_{20}Zr_8Ti_{10}Co_6Cu_3$ (elastic limit: 2600 MPa) were produced by planar flow casting, which involves forming a flow of liquid metal over a cooled wheel. From 10 to 20 g of alloy are placed in a distribution nozzle heated to between 1050 and 1150° C. The width of the nozzle slot opening is between 0.2 and 0.8 mm. The distance between the nozzle and the wheel is between 0.1 and 0.3 mm. The wheel onto which the molten alloy is deposited is a wheel made of copper alloy driven at a speed of 5 to 20 m/s. The pressure applied in order to expel the molten alloy through the nozzle is between 10 and 50 kPa. Table 1 below gives the characteristics of three ribbons obtained.

TABLE 1 characteristics of three ribbons used, made of $Ni_{53}Nb_{20}Zr_8Ti_{10}Co_6Cu_3$ alloy

| Ribbon | Length [cm] | Thickness [μm] | Variation in thickness [μm] | Height [mm] | Variation in height [mm] | Ductile/ fragile [—] |
|---|---|---|---|---|---|---|
| 1 | 900 | 84 | 0.8 | 1.23 | 0.01 | Ductile |
| 2 | 500 | 109 | 1.1 | 1.44 | 0.02 | Ductile |
| 3 | 1700 | 81 | 0.8 | 1.37 | 0.02 | Ductile |

The thermal properties were measured by DSC (Differential Scanning Calorimetry) on a Setaram Setsys Evolution 1700 at 10° C./min under 20 ml/min of Ar:

Tg=558° C.±2° C.

Tx=606° C.±1° C.

Tg and Tx are not significantly influenced by the conditions in which the ribbons are produced.

In order to determine the fixing coefficient for the shape of the spring, a ribbon is coiled in a ring of inside diameter $D_0$ and the diameter that the ribbon adopts in its unconstrained state after heat treatment, or "set" diameter $D_f$ is measured. The fixing coefficient is calculated as the ratio between the diameter in the completely relaxed state, assumed to be equal to the inside diameter of the ring $D_0$, and the diameter of curvature of the set ribbon $D_f$.

Shape-fixing relaxation annealing operations were carried out on ribbons 30 mm long, coiled up inside aluminum rings with an inside diameter equal to 7.8 mm, which is similar to the typical diameters of curvature of a mainspring. A Logotherm® resistance-heated oven under ambient atmosphere was used. The rings are placed on temperature-regulated alumina pads in the center of the oven, in order to guarantee an even temperature and rapid transmission of heat. The treatment duration was timed from the moment the door to the oven was closed. One second before the end of the countdown, the ring was picked up with tongs and quenched very quickly in around 2 liters of water at ambient temperature.

Once the ribbon had cooled, the diameter of curvature of the relaxed ribbon was measured with a vernier caliper with a precision of 0.2 mm.

In order to evaluate the ductile or fragile nature of the ribbon under bending, the set ribbon is positioned between the two parallel surfaces of the vernier caliper as in a two-point bending test. The separation at break is recorded by slowly bringing the two parallel surfaces of the vernier caliper closer together.

In order to determine the deformation at break of the ribbon or of the strip, it is necessary to take into consideration the fact that the curvature of a strip bent at 180° between two parallel surfaces a distance B apart is not at a constant radius. It passes through a maximum situated at the apex. The radius of curvature at the apex is connected to the separation by the following relationship, and is not dependent either on the properties of the material or on the dimensions of the ribbon:

$$R = \frac{\alpha}{2} \cdot B \text{ where } \alpha = 0.835 \qquad \text{Equation 1}$$

The deformation at the apex can be expressed approximately as:

$$\varepsilon = \frac{e}{2R} = \frac{e}{\alpha B} \qquad \text{Equation 2}$$

For a ribbon with an initial curvature $K_0=1/R_0$ that is non-zero, the deformation on the outermost surface becomes:

$$\varepsilon = \frac{e}{2}\left(\frac{1}{2} - K_0\right) = \frac{e}{2}\left(\frac{2}{\alpha B} - K_0\right) \qquad \text{Equation 3}$$

The maximum deformation before break $\epsilon_r$ is obtained with the separation at break $B_r$ and the initial curvature $(0.5\ D_0)^{-1}$. When $B_r$ becomes equal to 2·e, the deformation is limited to 1.

The test specimen is adjudged to be fragile if the deformation at break is less than 2% (with no prior plastic deformation).

FIG. 1 depicts the mechanical behavior of ribbons of $Ni_{53}Nb_{20}Zr_8Ti_{10}Co_6Cu_3$ alloy with a thickness of 81 microns at the various annealing temperatures and durations to which they were subjected. Note that there is a window of annealing parameters that do not weaken the ribbons. This window is wide enough to allow shaping to be performed repeatably. The limiting duration increases as the temperature decreases. For annealing performed in an oven, in the case of this alloy, the temperature needs to be more than 50°, advantageously 100° C., below Tg in order to have a suitable length of time available from a technological standpoint, namely a duration of a few minutes at least. With hot-air heating followed by quenching, the treatment time that is suitable from a technological standpoint is shorter (lower than one minute) and the temperature can therefore be higher.

As strain relief following the fixing of the shape is incomplete, the shape following fixing treatment is an expanded shape as compared with the shape imposed during the annealing. It has been noted that the coefficients of fixing $D_0/D_f$ for a given temperature followed a curve of sigmoid appearance and that the curve could be modeled by equation (4), which is a model that has been used to describe certain aspects of the relaxation of metallic glasses, notably by Fan et al. (Acta Materialia 52 (2004) 667-674):

$$\frac{1}{D_f} = \frac{1}{D_0}\exp\left[-\left(\frac{t}{t_0}\right)^{\beta}\right];\ \frac{D_0}{D_f} = \exp\left[-\left(\frac{t}{t_0}\right)^{\beta}\right] \qquad \text{Equation 4}$$

where β and $t_0$ are constants.

The relaxation of the curvature is more rapid for a thin ribbon than for a thick ribbon. It has been found that the change in curvature is not dependent on the imposed diameter, which means that there can be just one fixing coefficient $D_0/D_f$ for the shaping of a spring of variable curvature. The behaviors depicted in FIG. 2(*a*) show that the higher the temperature, the more rapid the relaxation.

The essentially amorphous nature of the raw and annealed ribbons was confirmed by X-ray diffraction. Two annealing operations were analyzed: the first in the ductile domain (430°/30 min) and the second in the fragile domain (530° C./10 min). Thus, no crystalline phase is detected in any one of the test specimens. However, it should be pointed out that this characterization technique is not able to detect with certainty the presence of nanocrystals, such that their presence cannot be excluded. Further, such nanocrystals can sometimes have a favorable impact on the mechanical properties of metallic glasses.

It is clear from FIGS. 1 and 2*a* that the higher the temperature, the more the ductile/fragile transition occurs at high fixing coefficients. Thus, for the $Ni_{53}Nb_{20}Zr_8Ti_{10}Co_6Cu_3$ alloy, only temperatures close to the glass transition temperature can be used to set the shape at more than 95% without weakening.

EXAMPLE 2

FIGS. 3*a*, 3*b* respectively depict curves of fixing and of deformation at break for a ribbon 68 μm thick made of an amorphous $Ni_{60}Ta_{40}$ alloy (at %, elastic limit: 2900 MPa), in which Tg=740° C. and Tx=768° C. These curves are the results of tests at 520° and 570° C. and show that the fixing behavior is similar to that of the $Ni_{53}Nb_{20}Zr_8Ti_{10}Co_6Cu_3$ alloy and that at 520° C., weakening has not been reached over the durations tested (up to 30 minutes).

EXAMPLE 3

FIGS. 4*a*, 4*b* respectively depict curves of fixing and deformation at break for a ribbon 73 μm thick made of an $Ni_{60}Nb_{10}Ta_{30}$ alloy (elastic limit: 2700 MPa), in which Tg=721° C. and Tx=747° C. These curves also show that the behavior is comparable with that of the two previous alloys.

The results displayed on these various diagrams lead to two observations: i) it is possible to give a ribbon of metallic glass a curvature by fixing below its glass transition temperature and ii) there is a range of temperatures and treatment domains within which the alloy remains ductile.

The sigmoid behavior of the expansion and the deformation at break as a function of time or as a function of annealing duration observed on the $Ni_{53}Nb_{20}Zr_8Ti_{10}Co_6Cu_3$ ribbons is similar to that of the other alloys tested. This behavior was also observed on alloys based on Fe and/or Co, some of which have no Tg or have a Tg>Tx. It may therefore be conceded that this behavior can be generalized to other metallic glass alloys, and that it is not therefore restricted to Ni-based alloys and/or to those that have a Tg<Tx.

As a general rule, an alloy has to satisfy a condition that is necessary so that the shaping below Tg, or respectively below Tx in the case of an alloy that has no Tg or that has Tg>Tx, can be used for a spring: the "fixing" window and the "ductile" window have to coincide. In the cases set out here, the time needed to set the shape is markedly shorter than the limited length of time that corresponds to a transition to a fragile state.

It has already been mentioned that the fixing coefficient is dependent on the thickness of the ribbon but not on the imposed curvature. The inventors checked that it was possible to obtain the theoretical unconstrained shape of a mainspring using just one fixing coefficient and a support made of copper. A slot 0.3 mm thick was formed by electrical discharge machining (edm) in a copper plate 1.5 mm thick, with a profile corresponding to the desired unconstrained shape of the spring but with radii of curvature contracted to 60% in order to take the $D_0/D_f$ expansion into consideration while at the same time maintaining the length of the various segments of the unconstrained shape at 100%.

A ribbon of metallic glass was placed in the slot of the support causing it to undergo elastic deformation and the fixing treatment was carried out in an oven under ambient atmosphere between two ceramic pads thermally regulated to 430° C., for 3 minutes, followed by the quenching of the support. This treatment corresponds to a fixing $D_0/D_f$=60% according to the charts obtained for fixing the shape in a ring. The ribbon, once it had been taken out of its support, displayed an unconstrained shape that corresponded almost perfectly to the desired unconstrained shape. FIGS. 5*a*, 5*b* respectively depict the desired unconstrained shape and the unconstrained shape with the curvatures contracted to 60% of the support.

According to another embodiment of the method, the spring is shaped not in an oven but using a jet of hot gas. Equipment of the "Sylvania Heater SureHeat Jet 074719" type with a power of 8 kW is used to heat compressed air and jet it against the support containing the ribbon. The equipment heats a gas (air or neutral gas such as argon, nitrogen or helium) up to 700° C., the ribbon being inserted in the slot of the copper support by elastic deformation as before.

The copper support is placed facing the hot gas distribution tube and is perpendicular thereto. It could also be held with a certain inclination, for example at 45°. The support is mounted on a three-position linear guidance system allowing i) the copper support to be positioned in a raised position, out of reach of the jet of gas ii) it to be positioned in the jet of hot gas and iii) it to be quenched immediately in a cooling liquid, such as water for example, at the end of the heat treatment.

According to yet other embodiments of the method, the support containing the ribbon is placed in a vacuum oven, or between two heated ceramic plates, these embodiments being given purely by way of nonlimiting example. Shaping may also be performed in two or more heat treatment stages.

Hitherto, we have considered only the fixing of a desired shape in a ribbon that was initially substantially straight, which means to say which initially has no other curvature than the curvature resulting from the manufacture of the ribbon. The shape given corresponds precisely to the shape of the respectively negative and positive curvatures of a mainspring around a point of inflection. However, the parts at the two ends are coiled up inside circular recesses in the support that are rendered necessary by limitations resulting from the thickness of the slot which has become greater than the space between turns of the desired unconstrained shape; they cannot therefore follow the desired shape over the entire length of the spring.

With a ribbon made of crystalline alloy for springs commonly used, such as Nivaflex® for example, the desired shape can be obtained by cold plastic deformation. This is notably the case for the internal end of the spring (known as the "eye" and representing the step of forming the eye). To do this it is necessary to anchor the spring to the barrel arbor: because the theoretical curve of the spring gives radii of curvature that are greater than that of the arbor it becomes necessary to connect the curvature that the spring forms around the arbor to the theoretical curvature, by cold deformation of the spring.

However, such a step cannot be transferred directly across to ribbons made of metallic glass: as mentioned earlier, plastic deformation of metallic glasses is highly ill-advised.

It was found to great surprise that a shaping of the ribbon by plastic deformation was possible, for the various alloys tested, without brittle fracture of the ribbon and without adversely affecting the mechanical properties of the shaped ribbon. Such a ribbon can therefore be used as a spring, particularly as a high performance spring, and more particularly as a mainspring.

This unexpected observation thus allows the desired definitive shapes to be applied by cold plastic deformation, before or after any fixing heat treatment. This shaping by plastic deformation can be limited to the eye (the internal end, see below), but can also be carried out on a more extensive part of the spring, or even on the entirety of the shape given to the spring.

Let us note at this point that the cut-out at the internal end of the spring that allows it to be attached to the hook of the barrel arbor core is cut by stamping in the traditional way. Other methods of attaching the spring to the barrel arbor may of course be used, for example welding.

A sliding mainspring bridle intended to be fixed to the external end of the spring is made of a strip 110 μm thick of the same alloy as that of the ribbon, obtained using the same planar flow casting technique and the same shaping by cold plastic deformation (see below) so as to give it the typical curvature of a sliding bridle for an automatic winding-up mainspring. The welding is (spot) resistance welding as is habitual. Other methods of attachment are of course also conceivable, such as laser welding for example.

FIG. 6*a* shows the characteristics for the winding-up and unwinding of a spring made of $Ni_{53}Nb_{20}Zr_8Ti_{10}Co_6Cu_3$ alloy with a thickness of 81 μm shaped by cold plastic deformation in the case of the internal end (the eye) and then by hot gas jet heating in a support as described hereinabove, with conditions corresponding to a fixing coefficient of 60%. The spring yields an entirely satisfactory behavior making it possible to achieve the target torque and number of turns, and demonstrates good fatigue behavior.

However, the spring measured in FIG. 6*a* has an eye formed by cold plastic deformation over a greater or lesser length (typically 40 mm in the case of FIG. 6*a*) with good repeatability, and the mainspring obtained exhibits good performance. The inventors therefore wish to know whether the method of obtaining the curvature of the eye by plastic deformation could be applied to the entire spring.

The technique of eye forming consists in deforming the strip by hammering. The curvature is adjusted using two parameters: the length of the step by which the ribbon is moved between two hammer blows and the amplitude of deformation, which is set by the angle of rotation of the hammer about its axis. These parameters have to be adapted to suit the alloy and the thickness of the ribbon.

Shaping by cold plastic deformation is performed in two stages: first of all, the external end of the ribbon is inserted so as to apply a negative curvature according to the desired theoretical curvature as far as the point of inflection. Next, the internal end is inserted so as to apply a positive curvature according to the theoretical curvature.

FIG. 6*b* shows the characteristic for winding up and unwinding of a spring made of $Ni_{53}Nb_{20}Zr_8Ti_{10}Co_6Cu_3$ alloy with a thickness of 81 μm shaped by cold plastic deformation alone. Despite the absence of fixing by heat treatment, the behavior of the spring is in every respect comparable to that of FIG. 6*a*.

The shaping of ribbons made of metallic glass alloy using plastic deformation is not restricted to the $Ni_{53}Nb_{20}Zr_8Ti_{10}Co_6Cu_3$ alloy alone. For example, the alloys of FIGS. 3 and 4 can also be shaped by plastic deformation. Other amorphous alloys based on Ni, Fe and/or Co can also be shaped with at least one stage of plastic deformation, and can be subjected to a fixing heat treatment in order to achieve additional curvature.

As can be seen from the foregoing description, it is possible to impart a curvature to a ribbon of amorphous metal alloy at temperatures well below Tg, or, respectively, well below Tx in the case of an alloy that has no Tg or has Tg>Tx, and to do so for several families of amorphous alloys. The "fixing coefficient", namely the ratio between the curvature imparted and the curvature obtained after heat treatment, is dependent on the thickness of the ribbon but not dependent on the imposed curvature, thus making it possible to shape a mainspring of variable curvature. This coefficient is also dependent on the shaking means used (oven, gas jet, etc.) and on characteristics of the equipment, because the temperature directly experienced by the ribbon is difficult to measure precisely.

In addition, the fixing annealing must not render the ribbon fragile and must therefore be done at a temperature and for a duration that are below the weakening point. In our experience, several amorphous Ni-based alloys as mentioned here, but also Fe-based or Co-based alloys exhibit sufficient resistance to weakening on annealing that a hot-forming operation can be applied to them.

The foregoing implies that for an alloy that has a good shaping window, there are a number of treatments that may lead to the same shape fixing level. Thus, the treatment conditions can be chosen to maximize the performance of the spring, or the treatment conditions may be combined with one another or with one or more hot or cold plastic deformation(s).

Ultimately, it is possible to set the shape of ribbons made of various alloys, including $Ni_{53}Nb_{20}Zr_8Ti_{10}Co_6Cu_3$ by deforming the spring plastically near to the internal end, or even along its entire length, if necessary supplementing the shaping with a heat treatment in an annealing window at a temperature below Tg and/or below Tx, with a treatment time that is applicable on an industrial scale. The ribbons remain ductile, do not lose their mechanical strength and maintain their amorphous or essentially amorphous nature. This method makes it possible to obtain, amongst other things, functional mainsprings with excellent properties.

The method described hereinabove may also be applied to the shaping of springs other than the mainspring, whether for components of clockwork movements (jumper spring or sliding bridle for mainspring, for example) or for clockmaking outer parts, case, or even bracelet.

The invention claimed is:

1. A method of making a timepiece spring comprising at least one monolithic ribbon of metallic glass having at least one curvature, wherein the method comprises a step of shaping said monolithic ribbon by plastic deformation in order to obtain at least part of said curvature.

2. The method as claimed in claim 1, in which the step of shaping the monolithic ribbon by plastic deformation is preceded by a step of obtaining this ribbon which involves jetting a liquid metal alloy capable of forming a metallic glass onto a cooled and moving substrate.

3. The method as claimed in claim 2, in which the monolithic ribbon of metallic glass is obtained by hyperquenching following one of the methods known as planar flow casting, melt-spinning, and twin roll casting.

4. The method as claimed in claim 2, in which the jetting is performed in such a way as to obtain a rate of cooling of the liquid metal alloy higher than 10000° C./s.

5. The method as claimed in claim 1, in which the jetting is performed in such a way as to obtain a monolithic ribbon having a thickness of between 50 and 150 μm.

6. The method as claimed in claim 1, in which the step of shaping by plastic deformation is preceded or followed by a step of fixing at least part of the monolithic ribbon.

7. The method as claimed in claim 1, in which the step of shaping by plastic deformation is preceded or followed by a step of fixing said part of curvature by heat treating at least this part of curvature.

8. The method as claimed in claim 7, in which the fixing step is performed by elastic deformation of said ribbon in a support followed by a fixing of the shape using said heat treatment.

9. The method as claimed in claim 7, in which the heat treatment is performed at a temperature and for a duration corresponding to a deformation at break of the metallic glass that is higher than 2%.

10. The method as claimed in claim 9, in which said heat treatment temperature is less than 50° C. below the glass transition temperature Tg of said metallic glass or than the crystallization temperature Tx for an alloy that does not have a Tg or for which Tg>Tx.

11. The method as claimed in claim 10, in which said heat treatment temperature is less than 100° C. below the glass transition temperature Tg of said metallic glass or than the crystallization temperature Tx for an alloy that does not have a glass transition temperature or for which Tg>Tx.

12. The method as claimed in claim 8, in which the support used for shaping the spring has the profile of the spring corresponding substantially to the unconstrained shape desired for the spring with radii of curvature contracted as a function of the fixing coefficient that is dependent on the thickness and on the alloy of said ribbon and on the temperature and duration chosen for the fixing, the length of the segments of said profile corresponding to the actual length of said unconstrained shape.

13. The method as claimed in claim 6, in which the coefficient of fixing is between 60% and 90%, preferably between 85 and 90%.

14. The method as claimed in claim 1, in which said plastic deformation is carried out at ambient temperature.

15. The method as claimed in claim 1, in which use is made of a metallic glass having an elastic limit higher than 2400 MPa.

16. The method as claimed in claim 1, in which the spring is a mainspring and the plastic deformation is applied at least to its internal part.

17. The method as claimed in claim 1, in which the entire spring is shaped by plastic deformation.

18. The method as claimed in claim 1, in which the spring is a mainspring having respectively positive and negative curvatures on either side of a point of inflection.

19. A spring obtained by the method according to claim 1.

20. A spring according to claim 19, which is a mainspring.

21. A timepiece including a spring according to claim 19.

22. A timepiece including a spring according to claim 20.

23. The method as claimed in claim 3, in which the jetting is performed in such a way as to obtain a rate of cooling of the liquid metal alloy higher than 10000° C./s.

24. The method as claimed in claim 8, in which the heat treatment is performed at a temperature and for a duration corresponding to a deformation at break of the metallic glass that is higher than 2%.

25. The method as claimed in claim 24, in which said heat treatment temperature is less than 50° C. below the glass transition temperature Tg of said metallic glass or than the crystallization temperature Tx for an alloy that does not have a Tg or for which Tg>Tx.

26. The method as claimed in claim 25, in which said heat treatment temperature is less than 100° C. below the glass transition temperature Tg of said metallic glass or than the crystallization temperature Tx for an alloy that does not have a glass transition temperature or for which Tg>Tx.

* * * * *